US006705266B2

(12) United States Patent
Tachikawa et al.

(10) Patent No.: US 6,705,266 B2
(45) Date of Patent: Mar. 16, 2004

(54) STARTER FOR INTERNAL COMBUSTION ENGINE

(75) Inventors: Junya Tachikawa, Saitama-ken (JP); Ryuichi Mori, Saitama-ken (JP); Koichi Fushimi, Saitama-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 99 days.

(21) Appl. No.: 10/116,031

(22) Filed: Apr. 5, 2002

(65) Prior Publication Data

US 2002/0166530 A1 Nov. 14, 2002

(30) Foreign Application Priority Data

May 9, 2001 (JP) ..... 2001-139222

(51) Int. Cl.[7] ..... F02N 17/00
(52) U.S. Cl. ..... 123/179.3; 123/179.1
(58) Field of Search ..... 123/179.1, 179.2, 123/179.3, 179.5, 179.31; 290/38 R, 30 R

(56) References Cited

U.S. PATENT DOCUMENTS 3,640,156 A * 2/1972 Mori et al. ..... 477/93
4,312,310 A * 1/1982 Chivilo' et al. ..... 123/198 DB
4,622,817 A * 11/1986 Kobayashi ..... 60/608
6,093,974 A * 7/2000 Tabata et al. ..... 290/40 R
6,102,176 A * 8/2000 Fujikawa ..... 192/3.58
6,460,500 B1 * 10/2002 Ooyama et al. ..... 123/179.3
6,463,375 B2 * 10/2002 Matsubara et al. ..... 701/54

* cited by examiner

*Primary Examiner*—John Kwon
(74) *Attorney, Agent, or Firm*—Arent Fox Kintner Plotkin & Kahn, PLLC

(57) ABSTRACT

A starter for an internal combustion engine is provided for improving the startability and reducing noise associated with starting. The starter for an internal combustion engine comprises an electric motor, an oil pump driven by the electric motor, an accumulator for accumulating an oil pressure pumped by the oil pump, a hydraulic actuator driven by the oil pressure accumulated in the accumulator, an oil pressure supply control valve for controlling the oil pressure supplied from the accumulator to the hydraulic actuator, a driven gear for rotation integral with a crank shaft of the internal combustion engine, a driving gear connected to the hydraulic actuator, and brought into mesh with the driven gear and driven by the hydraulic actuator when the internal combustion engine is started, an oil pressure sensor for detecting the oil pressure in the accumulator, and an ECU for controlling the electric motor based on the value of the oil pressure in the accumulator detected by the oil pressure sensor. The starter maintains the hydraulic actuator in a usable state irrespective of an operating condition of the engine to reduce a starting time, thereby making it possible to improve the startability and reduce the noise.

4 Claims, 3 Drawing Sheets

STARTER FOR INTERNAL COMBUSTION ENGINE

BACKGROUND OF THE INVENTION

1. Field of the Invention

The present invention relates to a starter for an internal combustion engine for starting the internal combustion engine by means of a hydraulic actuator.

2. Description of the Prior Art

A conventional starter of the type mentioned above is known, for example, from Laid-open Japanese Utility Model Registration Application No. 59-73579. This starter has an electric motor and a hydraulic motor such that an internal combustion engine (hereinafter simply called the "engine") can be started by means of either the electric motor or the hydraulic motor. The electric motor has a pinion spline-connected to its rotating shaft. Upon starting the engine, the pinion is axially slid by a plunge mechanism and meshed with a ring gear integrally formed on a crank shaft of the engine.

On the other hand, the hydraulic motor is disposed on the opposite side to the pinion with respect to the rotating shaft of the electric motor, and is coupled to the rotating shaft through a coaxial one-way clutch. The hydraulic motor is driven by an oil pressure accumulated in an accumulator, and controlled to start and stop by opening and closing an electromagnetic ON/OFF valve disposed between the accumulator and the hydraulic motor. The oil pressure is accumulated in the accumulator by a hydraulic pump directly coupled to the engine, where the accumulation of oil pressure is performed and stopped by opening and closing an electromagnetic valve disposed between the hydraulic pump and the accumulator. Also, the accumulation of oil pressure is performed under the condition that the oil pressure within the accumulator is equal to or lower than a predetermined value, and the vehicle is decelerating (the brake is trodden while the vehicle is running), i.e., utilizing regeneration energy.

Upon starting the engine, in this starter, the pinion of the electric motor is meshed with the ring gear by means of the plunge mechanism, and the hydraulic motor is driven when the oil pressure in the accumulator is equal to or higher than the predetermined value. In this manner, the rotation of the hydraulic motor is transmitted to the rotating shaft of the electric motor through the one-way clutch, and further from the pinion to the ring gear to start the engine. On the other hand, when the oil pressure in the accumulator is lower than the predetermined value, the hydraulic motor is stopped, and the electric motor is driven instead to start the engine.

As described above, the conventional starter uses the electric motor for starting the engine when the oil pressure in the accumulator is lower than the predetermined value. The electric motor, however, is disadvantageous in a longer time taken to start the engine, poor startability, and associated noise caused by the meshing of the pinion with the gear ring for a long time, due to its general characteristics of smaller output torque, as compared with the hydraulic motor, which results in a delay in establishing the rotation. Particularly, if the so-called idling stop, recently regarded as important as countermeasures to the environmental pollution and fuel economy, is applied, the foregoing disadvantages are more likely to appear prominently since the engine frequently repeats start and stop during traffic jam and the like. In this regard, since the starter accumulates the oil pressure by utilizing the regeneration energy during deceleration of the vehicle when the oil pressure in the accumulator is lower than the predetermined value, the oil pressure in the accumulator tends to be insufficient during traffic jam and the like, resulting in a failure in utilizing the hydraulic motor. For this reason, the electric motor is frequently used to start the engine, causing the aforementioned disadvantages to appear prominent.

OBJECT AND SUMMARY OF THE INVENTION

The present invention has been made in view of the problem mentioned above, and it is an object of the invention to provide a starter for an internal combustion engine which is capable of improving the startability and reducing noise associated with starting by maintaining a hydraulic actuator in a usable state irrespective of an operating condition of the internal combustion engine to reduce a starting time.

To achieve the above object, the present invention provides a starter for an internal combustion engine. The starter includes an electric motor, pumping means driven by the electric motor, an accumulator for accumulating an oil pressure pumped by the pumping means, a hydraulic actuator driven by the oil pressure accumulated in the accumulator, an oil pressure supply control valve for controlling the oil pressure supplied from the accumulator to the hydraulic actuator, a driven gear for rotation integral with a crank shaft of the internal combustion engine, a driving gear connected to the hydraulic actuator, and brought into mesh with the driven gear and driven by the hydraulic actuator when the internal combustion engine is started, oil pressure detecting means for detecting the oil pressure in the accumulator, and control means for controlling the electric motor based on the value of the oil pressure in the accumulator detected by the oil pressure detecting means.

According to the foregoing starter for an internal combustion engine, when the internal combustion engine is started, the driving gear is brought into mesh with the driven gear integrally formed on the crank shaft of the internal combustion engine, while the hydraulic actuator is driven by an oil pressure accumulated in the accumulator to rotate, and the rotation is transmitted to the driven gear through the driving gear to start the internal combustion engine. The oil pressure is accumulated in the accumulator by driving the pumping means such as an oil pump connected thereto by the electric motor. In addition, the oil pressure in the accumulator is detected by the oil pressure detecting means, so that the control means controls the operation of the electric motor based on the detected value of the oil pressure.

In the foregoing manner, the oil pressure in the accumulator is monitored at all times to control the operation of the electric motor based on the monitored oil pressure value, so that the oil pressure in the accumulator can be maintained at a level suitable for actuating the hydraulic actuator irrespective of the operating condition of the internal combustion engine. As a result, the internal combustion engine can be started at all times by utilizing the hydraulic actuator which provides a large output torque, even during traffic jam, when the idling stop is applied. Thus, by virtue of the resulting reduction in starting time provided by the rapidly established rotation of the internal combustion engine, it possible to improve the startability and reduce noise associated with the starting.

Preferably, in the starter for an internal combustion engine described above, the control means drives the electric motor when the value of the oil pressure in the accumulator detected by the oil pressure detecting means is equal to or lower than a predetermined value.

In this preferred configuration, the electric motor is driven to actuate the pumping means to increase the oil pressure in the accumulator when the oil pressure in the accumulator is reduced to the predetermined value or lower, so that a sufficient oil pressure can be ensured in the accumulator for driving the hydraulic actuator irrespective of the operating condition of the internal combustion engine. As a result, the aforementioned effects of the present invention can be reliably produced.

Also preferably, the starter for an internal combustion engine described above further includes power switching means for switching the transmission of power of the electric motor to the pumping means or to the driving gear.

In this preferred configuration, the power switching means acts to transmit the power of the electric motor to the pumping means, which is driven thereby, to accumulate the oil pressure in the accumulator as well as to transmit the power of the electric motor to the driving gear, which is driven thereby, to start the internal combustion engine. When the internal combustion engine is, for example, at an extremely low temperature, the electric motor will take a long time until its rotation is established due to its large friction in the starting of the internal combustion engine by the electric motor. On the other hand, the hydraulic actuator is required to ensure stable starting of the internal combustion engine because the hydraulic actuator can structurally provide a torque in a relatively short time. In such a case, according to the present invention, the electric motor for accumulating the oil pressure can be used additionally for starting the internal combustion engine, thereby making it possible to reduce the size and cost of the starter.

Also preferably, the starter for an internal combustion engine further includes oil pressure accumulating means for driving the hydraulic actuator to rotate in a direction reverse to a direction in which the hydraulic actuator is rotated when the internal combustion engine is started to accumulate the oil pressure pumped by the hydraulic actuator with power of the electric motor in the accumulator.

In this preferred configuration, the oil pressure pumped by the hydraulic actuator with the power of the electric motor is accumulated in the accumulator by the oil pressure accumulating means. In other words, since the hydraulic actuator additionally functions as the pumping means, the oil pump is eliminated, thereby making it possible to further promote the reduction in the size and cost of the starter.

DETAILED DESCRIPTION OF THE EMBODIMENTS

In the following, several embodiments of the present invention will be described with reference to the accompanying drawings.

Figure 1:
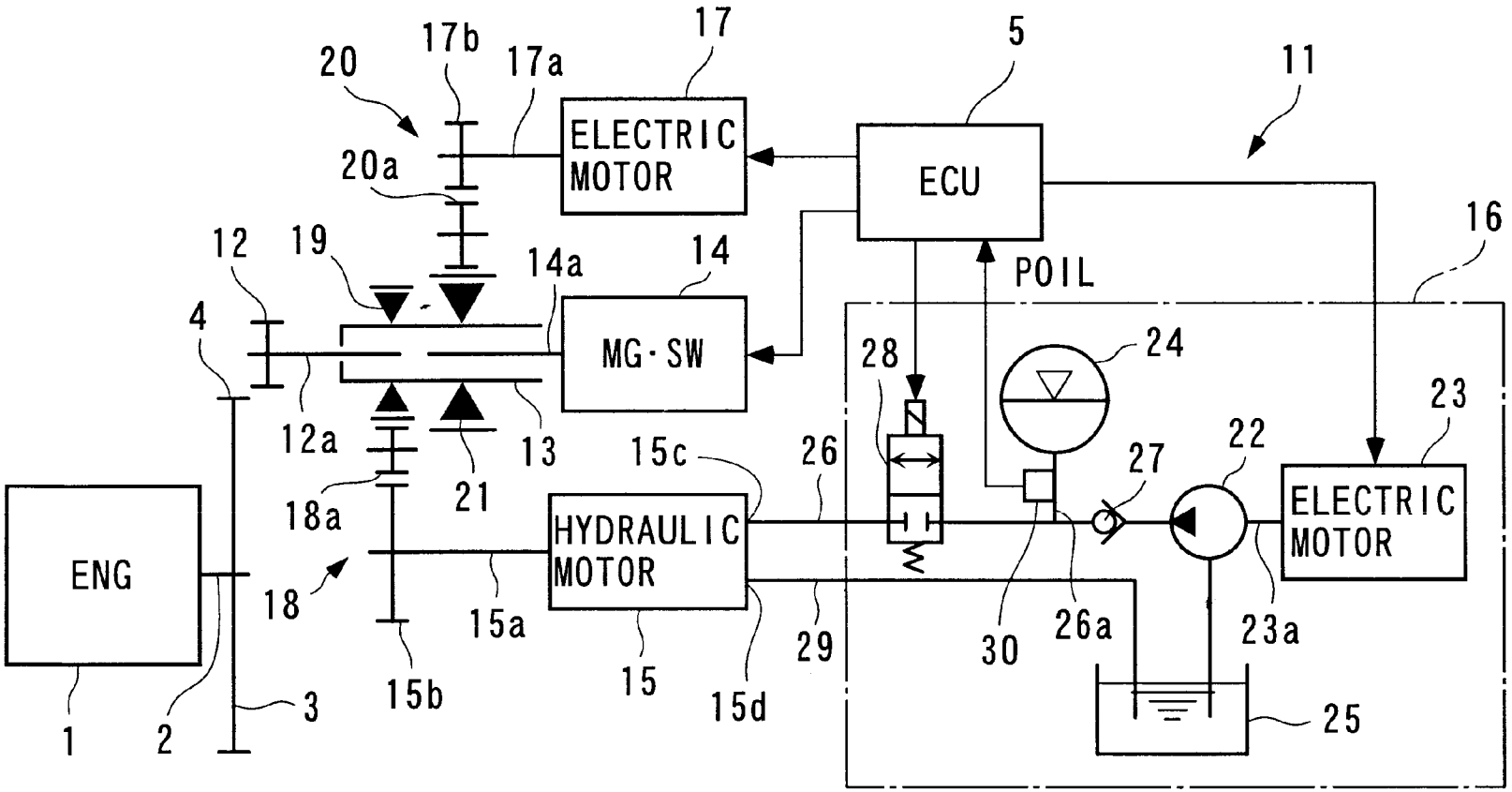
FIG. 1 is a block diagram generally illustrating the configuration of a starter for an internal combustion engine according to a first embodiment of the present invention.

FIG. 1 illustrates a starter for an internal combustion engine according to a first embodiment of the present invention. An internal combustion engine (hereinafter simply called the "engine") (ENG), designated by reference numeral 1, has a crank shaft 2 to which a fly wheel 3 is fixed. A ring gear 4 comprised of a helical gear is integrally formed on the outer peripheral surface of the fly wheel 3.

A starter 11, on the other hand, comprises the ring gear 4 (driven gear); a pinion gear 12 (driving gear); an output shaft 13 having one end coupled to the pinion gear 12; a magnet switch (MG•SW) 14 for moving the pinion gear 12 into mesh with the ring gear 4 upon starting the engine 1; a hydraulic motor 15 (hydraulic actuator) for driving the pinion gear 12 to rotate upon starting; a hydraulic motor driving mechanism 16 for driving the hydraulic motor 15; an electric motor 17 for auxiliary driving; and an ECU 5 for controlling the operation of the hydraulic motor 15 and the like.

The pinion gear 12 is comprised of a helical gear which can be meshed with the ring gear 4. The pinion gear 12 is fixed to one end of a pinion shaft 12*a* spline-connected coaxially with the output shaft 13, so that the pinion gear 12 is unrotatably and axially movably coupled to the output shaft 13.

The magnet switch 14 comprises a solenoid which includes a plunger 14*a*, and an exciting coil and a return spring contained in the magnetic switch 14 (none of them are shown), and the like. The plunger 14*a* is disposed coaxially with the output shaft 13. With the foregoing configuration, when the magnet switch 14 is not excited, the plunger 14*a* is spaced by and in opposition to the pinion shaft 12*a* of the pinion gear 12 to maintain the pinion gear 12 at an unmeshed position, at which the pinion gear 12 is not in mesh with the ring gear 4 (a state shown in FIG. 1). On the other hand, when the magnet switch 14 is excited, the plunger 14*a* is plunged to urge the pinion shaft 12*a* which drives the pinion gear 12 to a meshed position (not shown) at which the pinion gear 12 comes in mesh with the ring gear 4.

The hydraulic motor 15 is driven by an oil pressure supplied from the hydraulic motor driving mechanism 16. The hydraulic motor 15 has a rotating shaft 15*a* which is disposed in parallel with the output shaft 13 and coupled to the output shaft 13 through a speed increasing gear train 18 comprised of an output gear 15*b* and an intermediate gear 18*a* integrally formed on the rotating shaft 15*a*, and a one-way clutch 19. The one-way clutch 19 is set to transmit the rotation of the hydraulic motor 15 only when the hydraulic motor 15 is driven to drive the output shaft 13, and blocks the rotation of the output shaft 13 when the output shaft 13 rotates faster than the hydraulic motor 15.

The electric motor 17 is provided for driving the pinion gear 12 in place of the hydraulic motor 15, for example, when the engine 1 is at an extremely low temperature, for the reason stated above, to auxiliarily start the engine 1. The electric motor 17 also has a rotating shaft 17*a* which is disposed in parallel with the output shaft 13, and coupled to the output shaft 13 through a slowing down gear train 20 comprised of an output gear 17*b* and an intermediate gear 20*a* integrally formed on the rotating shaft 17*a*, and a one-way clutch 21. The one-way clutch 21 is also set to transmit the rotation of the electric motor 17 only when the electric motor 17 is driven to rotate the output shaft 13.

The hydraulic motor driving mechanism 16 comprises an oil pump 22 (pumping means); an accumulating electric motor 23 (electric motor) for driving the oil pump 22; an accumulator 24 for accumulating an oil pressure pumped by the oil pump 22; and the like. The oil pump 22 is directly coupled to the rotating shaft 23*a* of the electric motor 23, and has a suction port connected to a reserve tank 25. The oil pump 22 has a discharge port connected to an inlet port 15*c* of the hydraulic motor 15 through an oil passage 26 which is provided with a check valve 27. A branch passage 26*a* is branched from a location downstream of the check valve 27 of the oil passage 26. The accumulator 24 is arranged in the branch passage 26*a*. With the foregoing configuration, the oil pump 22 is driven in association with the actuated electric motor 23, and the oil pressure pumped by the oil pump 22 is sent through the check valve 27 into the accumulator 27 and accumulated therein.

The oil passage 26 is also provided with an electromagnetic ON/OFF valve 28 (oil pressure supply control valve) between the accumulator 24 and the hydraulic motor 15. This electromagnetic ON/OFF valve 28 is of a normal close type, i.e., closes the oil passage 26 in its unexcited state, and opens the oil passage 26 when it is excited by a driving signal from the ECU 5 to supply the hydraulic motor 15 with the oil pressure accumulated in the accumulator 24. The oil supplied to the hydraulic motor 15 is returned to the reserve tank 25 through an outlet port 15*d* of the hydraulic motor 15 and a return oil passage 29.

The branch passage 26*a* is further provided with an oil pressure sensor 30 (oil pressure detecting means) which detects an oil pressure POIL in the accumulator 25, and outputs a signal indicative of the detected oil pressure POIL to the ECU 5.

The ECU 5, which constitutes a control means in this embodiment, is based on a microcomputer which comprises an I/O interface, a CPU, a RAM, a ROM (none of them are shown), and the like. The ECU 5 outputs driving signals to the magnet switch 14, electric motors 17, 23, and electromagnetic ON/OFF valve 28 in accordance with the operating state of an ignition key (not shown), a detection signal from the oil pressure sensor 30, and the like, to control the operation of these components in the following manner.

First, when the engine 1 is in operation, the ECU 5 compares at all times the oil pressure POIL in the accumulator 24 (hereinafter simply called the "oil pressure") detected by the oil pressure sensor 30 with a predetermined value POILL which is set for the oil pressure POIL. The predetermined value POILL is set to an oil pressure value, for example, which is sufficient to drive the hydraulic motor 15. Then, when the oil pressure POIL decreases to the predetermined value POILL or lower, the ECU 5 drives the electric motor 23 to actuate the oil pump 22. In this manner, the oil pressure pumped by the oil pump 22 is accumulated in the accumulator 24. On the other hand, when the oil pressure POIL reaches a predetermined upper limit value POILH larger than the predetermined value POILL, the ECU 5 stops both electric motor 23 and oil pump 22. With the foregoing control strategy, the ECU 5 controls the oil pressure POIL in the accumulator 24 to be sufficiently high to drive the hydraulic motor 15 when the engine 1 is in operation, and maintains the pumped oil pressure by means of the check valve 27 after the engine 1 is stopped.

On the other hand, when the engine 1 is started, the ECU 5 drives the magnet switch 14 to move the pinion gear 12 to the meshed position for bringing the same into mesh with the ring gear 4, and excites the electromagnetic ON/OFF valve 28 to open the oil passage 26. In this manner, the oil pressure is supplied from the accumulator 24 to the hydraulic motor 15, thereby driving the hydraulic motor 15 to rotate. The rotation of the hydraulic motor 15, after speeded up by the speed increasing gear train 18, is transmitted to the output shaft 13 through the one-way clutch 19 to rotate the ring gear 4 through the pinion gear 12, causing the engine 1 to start. In this event, the rotation of the output shaft 13 is not transmitted to the electric motor 17 because the one-way clutch 21 is disposed between the output shaft 13 and the rotating shaft 17*a* of the electric motor 17.

When the engine 1 is started by the electric motor 17, the ECU 5 maintains the electromagnetic ON/OFF valve 28 in an unexcited state, and drives the electric motor 17. The rotation of the electric motor 17, after speeded down by the slowing down gear train 20, is transmitted to the output shaft 13 through the one-way clutch 21 to rotate the ring gear 4, causing the engine 1 to start. Likewise, in this event, the rotation of the output shaft 13 is not transmitted to the hydraulic motor 15 because the one-way clutch 21 is disposed between the output shaft 13 and the hydraulic motor 15. Further, after the started engine 1 causes the rotational speed of the ring gear 4 to exceed the rotational speed of the pinion gear 12, only the output shaft 13 is racing due to the existence of the one-way clutches 19, 21, so that the rotation of the engine 1 is not transmitted either to the hydraulic motor 15 or to the electric motor 17.

As described above, according to this embodiment, when the oil pressure POIL in the accumulator 24 is reduced to the predetermined value POILL or lower, the electric motor 23 is driven to actuate the oil pump 22 to pump the oil pressure POIL, thereby making it possible to maintain the oil pressure POIL in the accumulator 24 at a level high enough to drive the hydraulic motor 15. Therefore, the engine 1 can be started at all times by utilizing the hydraulic motor 15 which provides a large output torque, even during traffic jam, when the idling stop is applied. This results in improved startability and reduced noise, yielded by a reduced starting time thanks to rapidly established rotation. Also, when the engine 1 is at an extremely low temperature, the electric motor 1 can be started without fail by actuating the electric motor 17 instead of the hydraulic motor 15.

It should be understood that the positioning of the magnet switch 14, hydraulic motor 15 and electric motor 17 with respect to the output shaft 17 is not limited to that illustrated in FIG. 1, and a variety of implementations can be contemplated therefor. Though not shown, for example, the electric motor 17 may be disposed coaxially with the output shaft 13 through a planetary gear which decelerates the rotation of the electric motor 17, while the magnet switch 14 may be disposed in parallel with or coaxially with the output shaft 13. Alternatively, a high rotation (small) type hydraulic motor may be employed as the hydraulic motor 15, and disposed coaxially with the output shaft 13, in which case the starter 11 can be simplified by omitting the speed increasing gear train 18.

Figure 2:
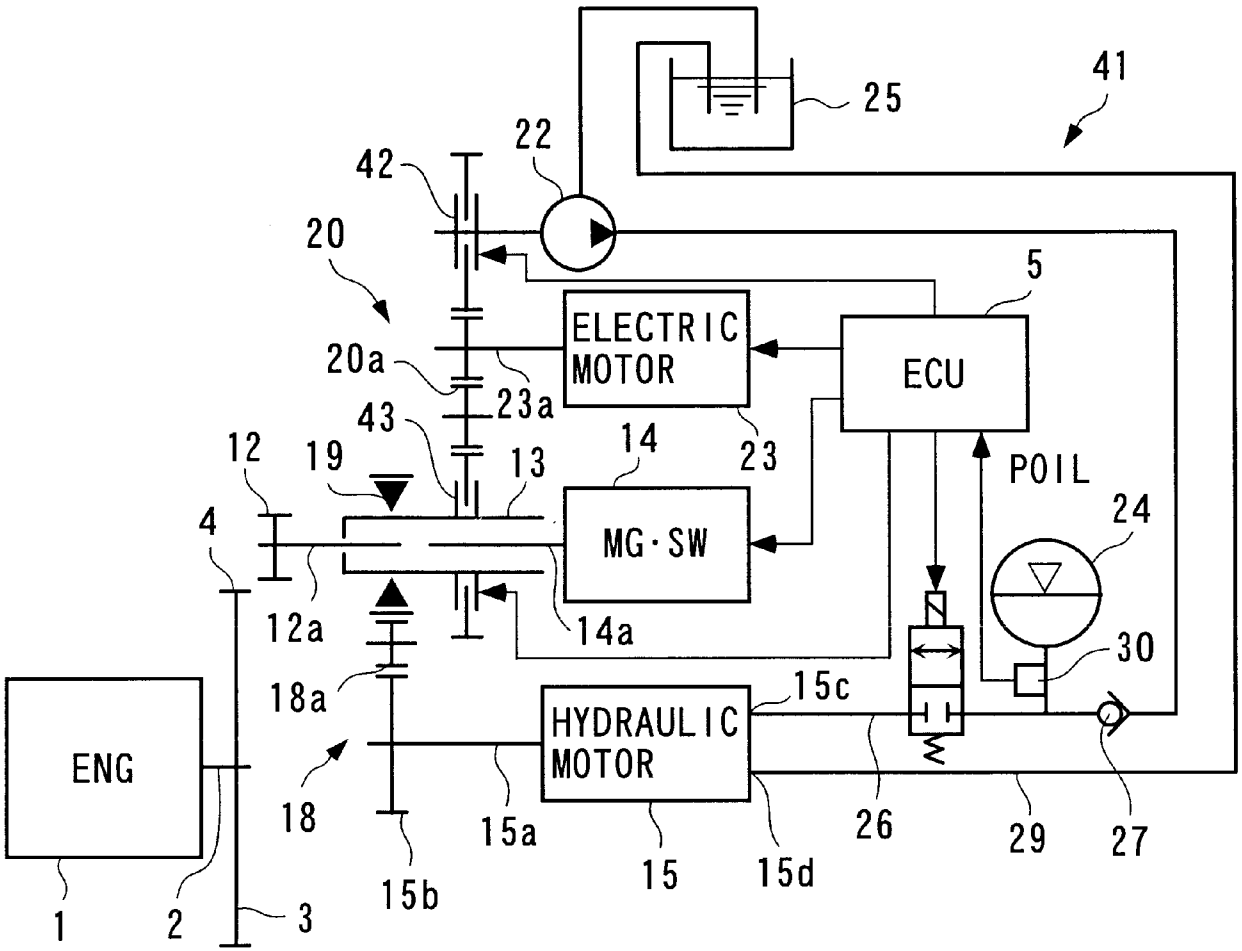
FIG. 2 is a block diagram generally illustrating the configuration of a starter for an internal combustion engine according to a second embodiment of the present invention.

FIG. 2 illustrates a starter according to a second embodiment of the present invention. In the following description, identical or similar components to those in the aforementioned first embodiment are designated the same reference numerals, and description thereon is omitted for convenience. As illustrated in FIG. 2, a starter 41 in the second embodiment differs from the starter 11 in the first embodiment in the following aspects. Specifically, the electric motor 23 has the rotating shaft 23*a* coupled to the oil pump 22 through a first electromagnetic clutch 42 (power switching means). Also, the rotating shaft 23*a* of the electric motor 23 is disposed in parallel with the output shaft 13, and a second electromagnetic clutch 43 (power switching means) is provided between the slowing down gear train 20 and the output shaft 13 instead of the one-way clutch 21 in the first embodiment. Associated with this modification, the electric motor 17 dedicated to starting in the first embodiment is removed in the second embodiment. The operation of these first and second electromagnetic clutches 42, 43 is controlled by the ECU 5. The rest of the configuration is similar to that of the first embodiment.

The starter 41 operates in the following manner. First, when the engine 1 is in operation, the ECU 5 maintains the second electromagnetic clutch 43 in a shutoff state. As the oil pressure POIL is reduced to the predetermined value POILL or lower, the ECU 5 drives the electric motor 23, and connects the first electromagnetic clutch 42. In this manner, the rotation of the electric motor 23 is transmitted to the oil pump 22 through the first electromagnetic clutch 42, so that the oil pump 22 is driven to accumulate the oil pressure in the accumulator 42. When the oil pressure POIL reaches the upper limit value POILH, the ECU 5 stops the electric motor 23, and shuts off the first electromagnetic clutch 42. With the foregoing control, the oil pressure OIL in the accumulator 24 can be maintained at a level high enough to drive the hydraulic motor 15, as is the case with the starter 11 in the first embodiment.

On the other hand, when the engine 1 is started by the hydraulic motor 15, the ECU 5 actuates the magnetic switch 14, excites the electromagnetic ON/OFF valve 28, and shuts off the second electromagnetic clutch 43 in a manner similar to the first embodiment. In this way, the engine 1 is started, whereas the rotation of the output shaft 13 is blocked by the second electromagnetic clutch 43 and therefore is not transmitted to the electric motor 23. On the other hand, when the engine 1 is started by the electric motor 23, the ECU 5 drives the electric motor 23, connects the second electromagnetic clutch 43, and shuts off the first electromagnetic clutch 32 to start the engine 1 without transmitting the rotation of the electric motor 23 to the oil pump 22 or the hydraulic motor 15.

As described above, according to the starter 41 of the second embodiment, the single motor 23 can be relied on to accumulate the oil pressure in the accumulator 24 as well as to start the engine 1 by appropriately switching the power transmitted from the electric motor 23 by the first and second electromagnetic clutches 42, 43. As a result, the starter 41 can be made compact and inexpensive as compared with the first embodiment which requires the two electric motors 17, 23.

Though not shown, the first and second electromagnetic clutches 42, 43 may be replaced by one-way clutches, respectively, as the power switching means, and a reversing circuit may be added for driving the electric motor 23 to rotate in the direction reverse to that when the engine 1 is started. In this configuration, one of the one-way clutches disposed between the output shaft 13 and the electric motor 23 is set to transmit the rotation to the output shaft 13 only when the electric motor 23 is rotating in the forward direction, and to transmit the rotation to the oil pump 22 only when the electric motor 23 is rotating in the backward direction. With the foregoing configuration, the electric motor 23 can be rotated in the forward and backward directions to start the engine 1 and accumulate the oil pressure in the accumulator 24, respectively.

In the embodiment illustrated in FIG. 2, the first electromagnetic clutch 42 and oil pump 22 are disposed on the opposite side of the electric motor 23 with respect to the output shaft 13. Alternatively, the oil pump 22 may be coupled to an idler shaft disposed between and in parallel with the rotating shaft 23*a* of the electric motor 23 and the output shaft 13, an idler gear in mesh with the rotating shaft 23*a* and output shaft 13 may be connected to and disconnected from the idler shaft by the first electromagnetic clutch 42. This configuration can offer a reduced space and common use of parts when the idler gear is provided.

Alternatively, the electric motor 23 may be coupled to the oil pump 22 at all times, and a flow passage switching mechanism may be provided for switching a discharge flow passage of the oil pump 22 to the accumulator 24 and to the reserve tank 25. In this configuration, the oil pressure can be accumulated by driving the electric motor 23 and switching the discharge flow passage of the oil pump 22 to the accumulator 24 by the flow passage switching mechanism. On the other hand, when the engine 1 is started by the electric motor 23, a load on the electric motor 23 can be reduced by switching the discharge flow passage of the oil pump 22 to the reserve tank 25 to relieve the oil pressure. Since this configuration eliminates the expensive power switching means such as the first and second electromagnetic clutches 42, 43, reversing circuit and the like in the second embodiment for using the electric motor 23 both for accumulating the oil pressure and for starting the engine 1, this configuration is advantageous in terms of the cost. In addition, this configuration is further advantageous in terms of the layout since the flow passage switching mechanism can be positioned separately from the starting mechanism such as the magnet switch 14, hydraulic motor 15 and the like.

Figure 3:
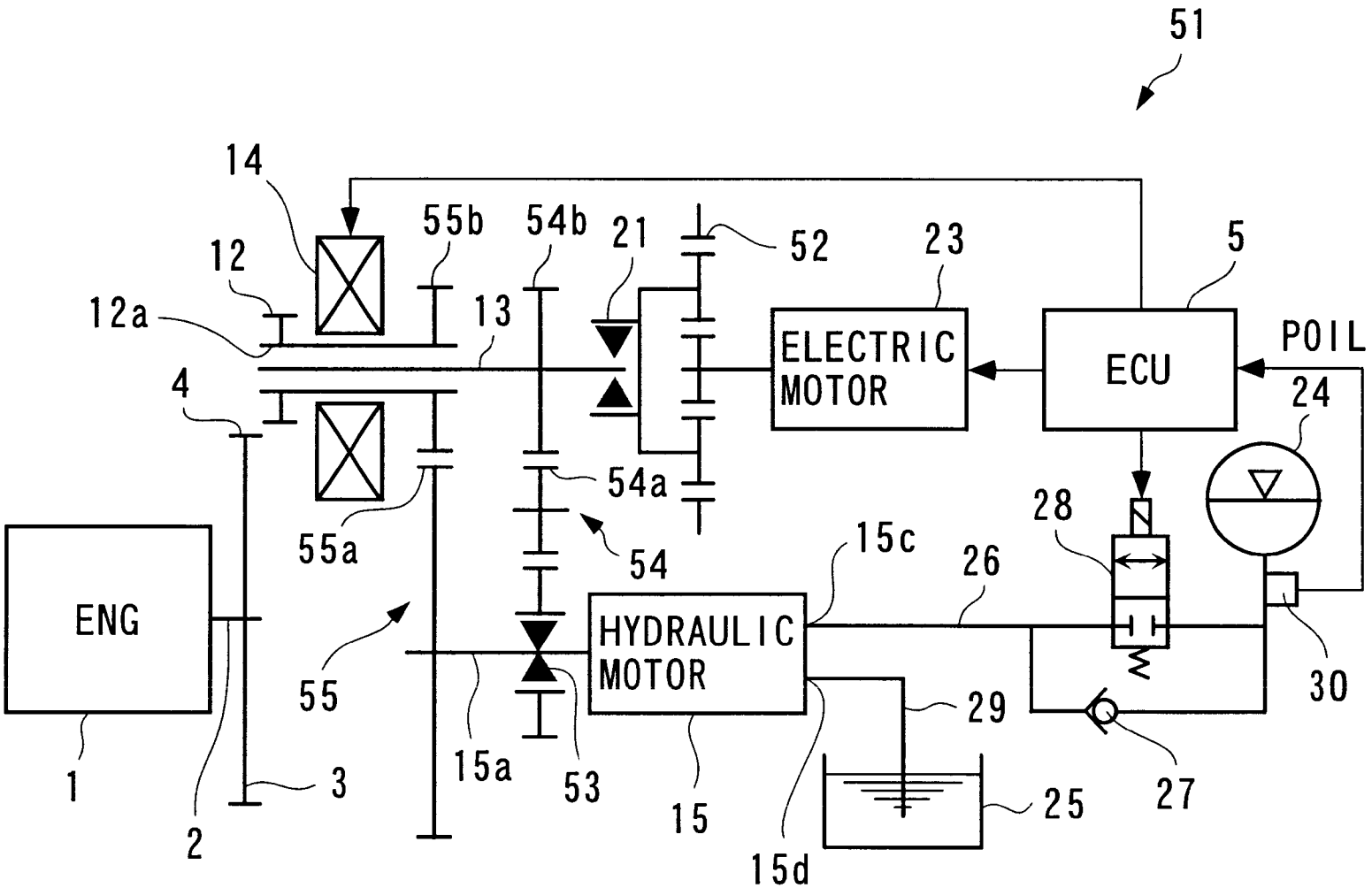
FIG. 3 is a block diagram generally illustrating the configuration of a starter for an internal combustion engine according to a third embodiment of the present invention.

FIG. 3 illustrates a starter according to the third embodiment of the present invention. As illustrated in FIG. 3, the starter 51 of the third embodiment comprises the check valve 27 and electromagnetic ON/OFF valve 28 disposed in parallel with each other in the middle of the oil passage 26 for connecting the inlet port 15*c* of the hydraulic motor 15 to the accumulator 24, and removes the oil pump 22 in the first embodiment. The electric motor 23 has the rotating shaft 23*a* coupled to the output shaft 13 through a planetary gear 52 and one-way clutch 21.

The hydraulic motor 15 in turn has the rotating shaft 15*a* coupled to the output shaft 13 through a one-way clutch 53 and a starting gear train 54 comprised of an intermediate gear 54*a* and a gear 54*b* integrally formed on the output shaft 13. A gear 55*a* is disposed at an end of the rotating shaft 15*a* of the hydraulic motor 15, while a gear 55*b* is disposed at an end of the pinion gear 12*a* opposite to the pinion gear 12 for mesh with the gear 55*a*. These gears 55*a*, 55*b*, which constitute an oil pressure accumulating gear train 55 (oil pressure accumulating means), are brought into mesh with each other when the pinion gear 12 is at an unmeshed position at which it is not in mesh with the ring gear 4 (a state shown in FIG. 3), and are released from the meshing when the pinion gear 12 is at a meshed position.

The starter 51 operates in the following manner. First, when the engine 1 is started by the hydraulic motor 15, the ECU 5 drives the magnet switch 14, and excites the electromagnetic ON/OFF valve 28, as is the case with the first and second embodiments. Consequently, the pinion gear 12 comes into mesh with the ring gear 4, so that the rotation of the hydraulic motor 15 is transmitted to the output shaft 13 through the starting gear train 54 to start the engine 1. In this event, the oil pressure accumulating gear train 55 is released from meshing as the pinion gear 12 moves to the meshed position, so that the start of the engine 1 is not affected. The rotation of the hydraulic motor 15 is blocked by the one-way clutch 21, so that it is not transmitted to the electric motor 23.

When the engine 1 is started by the electric motor 23, the ECU 5 drives the magnet switch 14, maintains the electromagnetic ON/OFF valve 28 in an unexcited state, and drives the electric motor 23. In this manner, the rotation of the electric motor 23 is transmitted to the output shaft 13 through the planetary gear 52 and one-way clutch 21 to start the engine 1. In this event, the rotation of the electric motor 23 is not transmitted to the hydraulic motor 15 due to the oil pressure accumulating gear train 55 released from meshing, and the existence of the one-way clutch 53.

On the other hand, when the engine 1 is in operation, the ECU 5 sets the magnetic switch 14 inoperative, maintains the electromagnetic ON/OFF valve 28 in an unexcited state, and drives the electric motor 23 when the oil pressure POIL is reduced to the predetermined value POILL or lower. In this manner, the rotation of the electric motor 23 is transmitted to the output shaft 13, as is the case with the staring, and further transmitted to the rotating shaft 15*a* of the hydraulic motor 15 through the oil pressure accumulating gear train 55 which has the gears 55*a,* 55*b* in mesh with each other. The rotation of the electric motor 23 is not transmitted to the hydraulic motor 15 through the starting gear train 54 due to the existence of the one-way clutch 53. Therefore, the hydraulic motor 15 is driven by the electric motor 23 for rotation through the oil pressure accumulating gear train 55. Also, since the starting gear train 54 differs from the oil pressure accumulating gear train 55 in the number of gear stages by one, the rotating shaft 15*a* of the hydraulic motor 15 is rotated in a direction reverse to that upon starting. As a result, the oil pressure pumped by the reverse rotation of the hydraulic motor 15 is sent to the accumulator 24 through the inlet port 15*c,* oil passage 26 and check valve 27, and accumulated in the accumulator 24. The electric motor 23 is stopped when the oil pressure POIL reaches the upper limit value POILH.

As described above, according to the starter 51 of the third embodiment, the hydraulic motor 15 can be switched between a starting mode in which the hydraulic motor 15 is driven by the oil pressure in the accumulator 24 in the forward direction to start the engine 1 and an accumulation mode in which the hydraulic motor 15 is driven by the electric motor 23 to rotate in the backward direction to accumulate the oil pressure in the accumulator 24. As a result, the oil pump 22 used for accumulation in the first embodiment can be eliminated, so that the starter 51 can be made correspondingly more compact and inexpensive. Since the third embodiment eliminates the expensive power switching means such as the first and second electromagnetic clutches 42, 43, and the like in the second embodiment for using the electric motor 23 both for accumulating the oil pressure and for starting the engine 1, the third embodiment is advantageous in terms of the cost. While the third embodiment employs the hydraulic motor 15 as an oil pump by rotating the hydraulic motor 15 backward, a hydraulic motor of a cam plate type with an inverting mechanism, for example, may be employed, in which case the hydraulic motor can be used as an oil pump without rotating it backward. With such a hydraulic pump, the intermediate gear 54*a* used in the third embodiment for rotating the hydraulic motor 15 in the backward direction is eliminated, thereby making it possible to correspondingly reduce the number of parts.

As described above, according to the starter for an internal combustion engine of the present invention, so that the oil pressure in the accumulator can be maintained at a level suitable for actuating the hydraulic actuator irrespective of the operating condition of the internal combustion engine. Accordingly, the internal combustion engine can be started at all times by utilizing the hydraulic actuator which provides a large output torque. Thus, by virtue of the resulting reduction in starting time, it possible to improve the startability and reduce noise associated with the starting.

In addition, a sufficient oil pressure can be ensured in the accumulator for driving the hydraulic actuator irrespective of the operating condition of the internal combustion engine, so that the aforementioned effects of the present invention can be reliably produced.

With the provision of the power switching means (first and second electromagnetic clutches 42, 43), the electric motor can be used both for accumulating the oil pressure in the accumulator and for starting the internal combustion engine, thereby making it possible to reduce the size and cost of the starter.

Also, with the provision of the oil pressure accumulating means (oil pressure accumulating gear train 55), the hydraulic actuator can be additionally used as the pumping means, thereby making it possible to further promote the reduction in the size and cost of the starter.

What is claimed is:

1. A starter for an internal combustion engine comprising:

an electric motor;

pumping means driven by said electric motor;

an accumulator for accumulating an oil pressure pumped by said pumping means;

a hydraulic actuator driven by the oil pressure accumulated in said accumulator;

an oil pressure supply control valve for controlling the oil pressure supplied from said accumulator to said hydraulic actuator;

a driven gear for rotation integral with a crank shaft of said internal combustion engine;

a driving gear connected to said hydraulic actuator, said driving gear brought into mesh with said driven gear and driven by said hydraulic actuator when said internal combustion engine is started;

oil pressure detecting means for detecting the oil pressure in said accumulator; and control means for controlling said electric motor based on the value of the oil pressure in said accumulator detected by said oil pressure detecting means.

2. A starter for an internal combustion engine according to claim 1, wherein said control means drives said electric motor when the value of the oil pressure in said accumulator detected by said oil pressure detecting means is equal to or lower than a predetermined value.

3. A starter for an internal combustion engine according to claim 1, further comprising power switching means for switching the transmission of power of said electric motor to said pumping means or to said driving gear.

4. A starter for an internal combustion engine according to claim 1, further comprising oil pressure accumulating means for driving said hydraulic actuator to rotate in a direction reverse to a direction in which said hydraulic actuator is rotated when said internal combustion engine is started to accumulate the oil pressure pumped by said hydraulic actuator with power of said electric motor in said accumulator.

* * * * *